US005694838A

United States Patent [19]

Moll

[11] Patent Number: 5,694,838

[45] Date of Patent: Dec. 9, 1997

[54] POSITIONING DEVICE

[75] Inventor: Herbert Moll, Dürnau, Germany

[73] Assignee: Hinderer & Muhlich KG, Goppingen, Germany

[21] Appl. No.: 739,421

[22] Filed: Oct. 29, 1996

[30] Foreign Application Priority Data

Nov. 4, 1995 [DE] Germany ..... 195 41 170.6

[51] Int. Cl.[6] ..... B41F 11/02

[52] U.S. Cl. ..... 101/3.1; 411/353; 101/28

[58] Field of Search ..... 411/347, 348, 411/352, 353, 512; 101/29, 28, 3.1

[56] References Cited

U.S. PATENT DOCUMENTS

| | | | |
|---|---|---|---|
| 3,052,940 | 9/1962 | Sellers | 411/348 |
| 5,136,936 | 8/1992 | Holliday | 101/28 |
| 5,461,976 | 10/1995 | Forehand | 101/31.1 |

FOREIGN PATENT DOCUMENTS

| | | |
|---|---|---|
| 2810093 | 7/1979 | Germany . |
| 1459267 | 3/1974 | United Kingdom . |

*Primary Examiner*—Edgar S. Burr
*Assistant Examiner*—Dave A. Ghatt
*Attorney, Agent, or Firm*—Woodbridge & Associates

[57] ABSTRACT

A positioning device for accurately positioning a male die member of an embossing tool in relation to a female die member thereof comprises a housing element which is adapted to be temporarily fixed in a hole in the male die member and a holding element disposed movably in the housing element. The holding element is axially displaceable relative to the housing element between a position in which it projects into a hole in the male die member and temporarily fixes the male die member in position, and a position of being retracted into the housing element to release the male die member. Disposed between the housing element and the holding element is a spring which is mechanically stressed in the retracted position of the holding element.

12 Claims, 1 Drawing Sheet

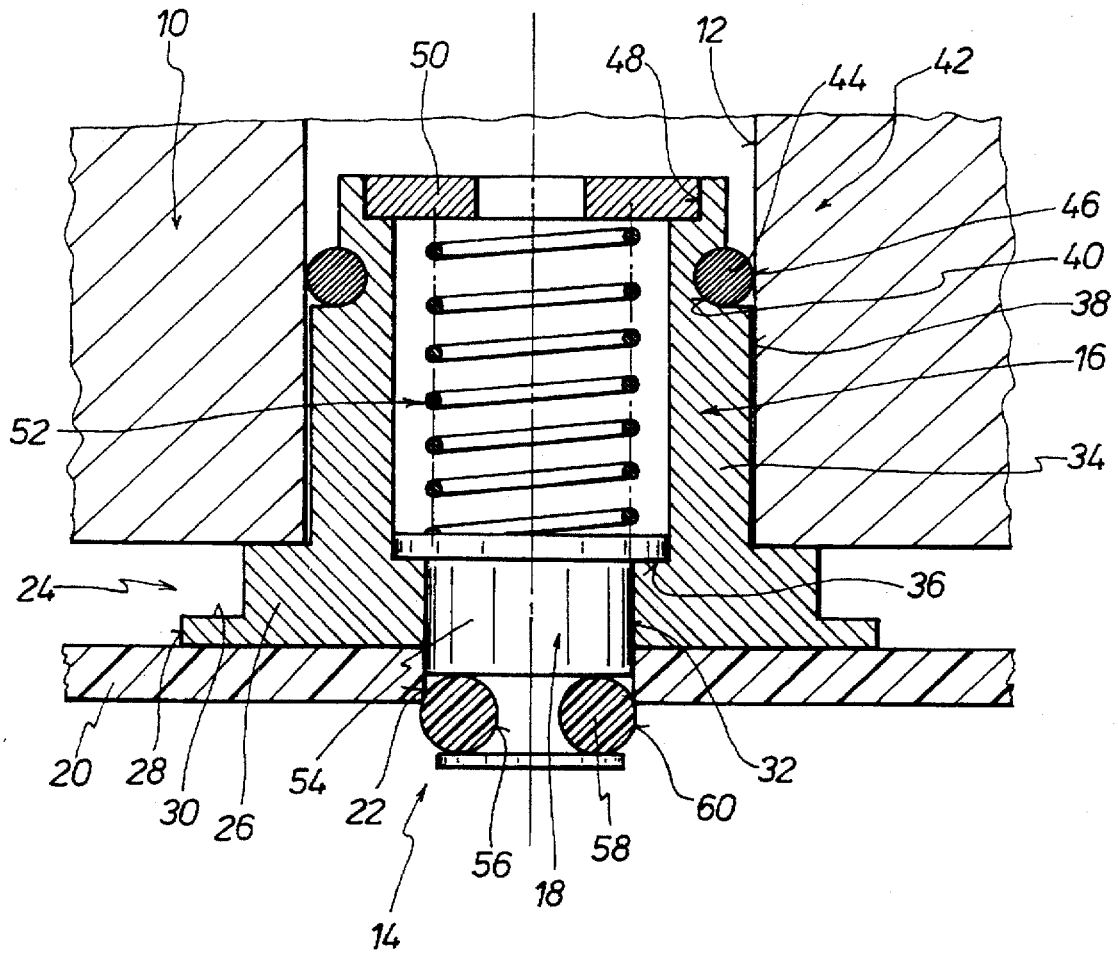
10
50
48
12
44
42
46
40
38
16
52
34
24
36
20
28
30
26
54
22
56
18
58
60
32
14

POSITIONING DEVICE

FIELD OF THE INVENTION

The invention concerns a positioning device for accurately positioning a male die member of an embossing tool and a female die member thereof in relation to each other.

In this specification the term embossing tool is used for the sake of conciseness and brevity to denote for example embossing, stamping, coining or like tools involving a male and a female die member which are movable relative to each other to produce the required shape.

BACKGROUND OF THE INVENTION

It is a known practice for a male die member of an embossing tool to be positioned in relation to a female die member thereof by means of positioning devices in the form of pins which are inserted into appropriately corresponding holes in the female die member. Those pins may also be designed with spacer rings thereon. The positioning devices of that kind suffer from the shortcoming that the male die member is often not reliably held fast to the positioning devices and thus to the co-operating female die member. Disengagement of the male die member from the female die member in that way can cause serious problems.

DE 28 10 093 A1 discloses a pressing or stamping apparatus having an upper block member and a lower block member which are movable towards and away from each other. A female die member is disposed on the lower block member. Projecting away from the upper block member is a male die member which is accurately fittingly oriented in relation to the female die member. The male die member extends through a pressure plate which is resiliently connected to the upper block member by means of a spring assembly in such a way that, upon actuation of the pressing or stamping apparatus, the pressure plate firstly comes to bear against the workpiece to be pressed or stamped in order securely to fix the workpiece in the appropriate position. Subsequently thereto, the male die member then comes into contact with the secured workpiece. The stamping operation, that is to say movement of the male die member into the female die member, then takes place as the upper block member moves closer towards the lower block member. In that arrangement the spring assembly which connects the pressure plate to the upper block member remains connected to the pressure plate at all times.

GB 1 459 267 describes a pressing or stamping apparatus which has an upper block member and a lower block member. Mounted on the upper block member is a pressure plate which is disposed movably in relation to the upper block member, by way of a connecting means. A spring device is provided for resiliently movably connecting the pressure plate to the upper block member. That pressing or stamping apparatus also provides that the pressure plate is permanently connected to the upper block member by way of the above-mentioned connecting means.

SUMMARY OF THE INVENTION

An object of the present invention is to provide a positioning device for the die members of an embossing tool, which can provide for reliably holding the die members relative to each other.

Another object of the present invent ion is to provide a positioning device for positioning a male die member of an embossing tool in relation to a female die member in secure but easily releasable relationship.

Still another object of the present invention is to provide a positioning device for locating the die members of an embossing tool relative to each other which while providing for properly secured location of the die members relative to each other can be readily mounted to one of the die members for the subsequent positioning operation and thereafter can be readily removed from its mounted condition.

In accordance with the principles of the present invention the foregoing and other objects are attained by a positioning device for accurately positioning a male die member of an embossing tool and a female die member thereof in relation to each other, comprising a housing means adapted to be temporarily fixed to one of the die members. A holding means is disposed in the housing means axially displaceably with respect to the housing means between a first position of engaging the other of the die members thereby to hold same fast, and a second position of being retracted into the housing means, thereby to release the other die member. A spring is operatively disposed between the housing means and the holding means and is adapted to be mechanically stressed in the second retracted position of the holding means.

In another aspect of the invention the foregoing and other objects are achieved by a positioning device for positioning a male die member of an embossing tool in relation to a female die member thereof, comprising a housing element adapted to be temporarily fixed in a hole in the female die member, and a holding element disposed in the housing element and adapted to be axially displaceable with respect to the housing element between a first position in which it projects into a hole in the male die member and holds the male die member fast and a second position in which it is retracted into the housing element and releases the male die member, and a spring member operatively disposed between the housing element and the holding element and adapted to be mechanically stressed in said second retracted position of the holding element.

As will be seen in greater detail hereinafter from a description of a preferred embodiment of the invention, the positioning device according to the invention enjoys the advantage that it is suitable for reliably holding a male die member in relation to the associated female die member and it is also advantageously suitable for automatically releasing the male die member again after accurate positioning of the male die member in relation to the female die member and fixing of the male die member to an associated component of the embossing tool. After the embossing tool component to which the male die member is fixed and a second component of the embossing tool to which the female die member is fixed have been moved away from each other, the positioning device can then be easily removed from its mounting on the female die member so that the positioning device then no longer constitutes any impediment to ready access between the male die member and the female die member of the embossing tool, for a substrate which is to be embossed thereby.

In a preferred feature of the invention the housing element is of a sleeve-like configuration and in an outside peripheral surface thereof has a groove which extends therearound and in which there is arranged a spring ring. The groove and the spring ring are preferably so dimensioned that the spring ring projects beyond the outside peripheral surface, with an outside peripheral portion.

As in an embossing tool of that kind the female die member usually comprises a suitable metal or a suitable metal alloy such as for example brass, it is preferable for the spring ring to comprise a spring metal and to be in the form of an open O-ring. Spring rings of that kind are desirably commercially available standard components which are available at inexpensive cost. By virtue of the housing element of the positioning device according to the invention having a spring ring of spring metal in the form of an open O-ring, the positioning device can be reliably fixed in an associated hole for mounting it in the female die member. The positioning device according to the invention can also be removed again from the mounting hole in the die member with a specific and controlled movement and without involving a great deal of time and complication if, at its end portion which is towards the male die member, the housing element is provided with an annular flange having an undercut configuration. In that case the annular flange firstly serves for providing for accurately defined spacing of the male die member which is arranged in accurately positioned relationship with respect to the female die member, and then the undercut configuration that the annular flange desirably includes serves in particular to permit the positioning device to be engaged for example by the gripping claws of a gripping tool and thus removed therewith from its mounting hole in the female die member. The gripping tool may be any suitable gripping tool which can perform that removal operation and may be for example a tool which is similar to a suitably modified insulation-stripping pincer tool as is used for stripping insulation from the wires of an installation cable.

In a preferred feature of the invention the holding element is of a piston-like configuration including a holding pin portion which is arranged to project out of the housing element, while the spring member bears against a terminal closure portion of the housing element, at an end thereof remote from the holding pin portion. The terminal closure portion may be an annular end portion which is suitably fixed to the sleeve-like housing element, for example by peening or the like.

The holding pin portion preferably has a groove extending around the periphery thereof, for accommodating a spring ring. In a preferred configuration of that kind the groove and the spring ring are so dimensioned that an outside peripheral portion of the spring ring projects radially beyond the holding pin portion. The spring ring may preferably comprise a rubber material and is in the form of a closed O-ring. Like the above-mentioned spring ring of the housing element, this spring ring on the holding pin portion is a commercially available, low-cost standard component. The spring ring on the holding pin portion advantageously comprises a rubber material in particular for the reason that the male die member which is temporarily secured in accurately positioned relationship with respect to an associated female die member by means of the positioning devices according to the invention usually comprises a suitable plate-like plastic material.

It will be noted in this respect that the spring ring of rubber material either serves to be clamped or locked in a hole in the male die member or to urge the male die member against the annular flange of the housing element, if the longitudinal dimension of the holding pin portion is of suitable magnitude. At any event the holding pin portion projects beyond the male die member which is temporarily held fast to the positioning device. When then the combination of the female die member and the male die member which is accurately positioned thereon is clamped between the appropriate components of an associated embossing tool, the holding pin portion is moved back into the housing element and the male die member fixed to the associated component of the embossing tool, for example by means of adhesive strips or the like. The movement of the holding pin portion back into its associated housing element of the positioning device simultaneously automatically provides that the male die member is released from the positioning device and consequently from the female die member to which the positioning device is fixed, for example by being mounted in a suitable mounting hole therein. After the two components of the embossing tool have been moved away from each other and thus after the male die member which is fixed to one component of the embossing tool and the female die member which is fixed to the other component thereof have been moved away from each other, it is thus easily possible, as already mentioned above, to remove the positioning device from the female die member, for example by means of a suitable gripping tool, after which access for a substrate to be embossed, between the female and male die members of the embossing tool, is no longer impeded by the presence of positioning devices.

It will be noted at this point that a substrate to be embossed may be any suitable substrate such as a paper substrate or a combination of a paper substrate with an embossing foil. In the last-mentioned case it may be desirable for the matrix to be adapted to be heatable.

Further objects, features and advantages of the invention will be apparent from the following description of a preferred embodiment of the invention.

BRIEF DESCRIPTION OF THE DRAWING

The single FIGURE of the accompanying drawing is a view on an enlarged scale of a positioning device according to the invention in combination with a portion of a female die member of an embossing tool and a portion of a male die member of the embossing tool.

DESCRIPTION OF THE PREFERRED EMBODIMENT

Referring to the drawing shown therein is a portion of an embossing tool comprising a female die member 10 having therein a hole 12 in which a positioning device as generally indicated at 14 can be temporarily fixed. The positioning device 14 has a sleeve-like housing element 16 and a holding element 18 which is disposed in the housing element 16 and which is axially displaceable therein, in a piston-like manner, The holding element 18 serves for temporarily fixing a male die member 20 of which a portion is shown, in relation to the female die member 10. The male die member 20 has a hole 22 for receiving a portion of the holding element 18, as will be described hereinafter. It will be seen therefore that the holding element 18 is axially displaceable with respect to the housing element 16 between a first position of projecting into the hole 22 in the male die member 20 to hold the male die member 20 fast with respect to the female die member 10, and a second position in which it is retracted into the housing element 16 and thus releases the male die member.

At its end portion 24 which is towards the male die member 20 the sleeve-like housing element 16 has an annular flange 26 which, along its outside periphery 28, has a portion of an undercut configuration as indicated at 30.

At its inside the annular flange 26 has a central bore 32, the diameter of which is smaller than the inside diameter of the sleeve portion indicated at 34 of the housing element 16. The sleeve portion 34 is accommodated in the hole 12 in the female die member 10. In that way, formed between the central bore 32 in the annular flange 26 and the sleeve portion 34 is an annular step 36 which forms an abutment or limiting means for the holding element 18. The FIGURE shows the holding element 18 in its position of butting against the step 36 and thus in its position of projecting to its maximum extent out of the housing element 16.

At its outside peripheral surface 38 the housing element 16 has a groove 40 which extends around the periphery thereof and which is disposed at the end portion 42, which is remote from the annular flange 26, of the housing element 16 or more specifically the sleeve portion 34 thereof. The peripherally extending groove 40 serves to receive a spring ring 44 which may be an open O-ring comprising a suitable material such as a spring metal. The groove 40 and the spring ring 44 are so dimensioned that the spring ring 44 has an outside peripheral portion 46 thereof projecting beyond the outside peripheral surface 38 of the housing element 16, and presses resiliently radially outwardly against the cylindrical inside wall surface of the hole 12 in the female die member 10 and thereby temporarily retains the positioning device 14 in the hole 12 in the female die member 10.

The end portion 42 of the housing element 16 is formed with a central enlarged portion 48 which serves for fixing a terminal closure portion 50 therein. The terminal closure portion 50 is in the form of an annular end portion and is fixedly connected to the housing element 16, by any suitable means such as glueing, soldering, welding, peening or the like.

Disposed between the terminal closure portion 50 and the piston-like holding element 18, in the interior of the sleeve-like housing element 16, is a spring member 52 shown in the form of a compression coil spring. The spring member 52 urges the holding element 18 into the position shown in the FIGURE, in which the male die member 20 is reliably held fast to the female die member 10 in accurately positioned relationship by the holding element 18.

The holding element 18 has a holding pin portion 54 of an outside diameter which, with sliding fit tolerance, is matched to the central bore 32 in the annular flange 26 of the housing element 16. At its free end part, the holding pin portion 54 has a peripherally extending groove 56 in which a spring ring 58 is accommodated. The groove 56 and the spring ring 58 are so dimensioned that the spring ring 58 projects radially with an outside peripheral portion 60 beyond the holding pin portion 54. The spring ring 58 is preferably in the form of a closed O-ring comprising a suitable material such as rubber. The spring ring 58 serves for temporarily reliably fixing the male die member 20 to the positioning device 14 and thus the female die member 10.

When the male die member 20 is accurately suitably positioned and fixed to the female die member 10 by means of the positioning device 14, the combination of the female die member 10 and the male die member 20 is arranged between the two components (not shown) of an embossing tool and those two components are moved towards each other. In that procedure, in a first working step, the respective holding pin portion 54 is urged into the associated housing element 16, while at the same time the corresponding spring member 52 is mechanically stressed. In that retracted position of the holding element 18, at the same time the male die member 20 is released from the positioning device 14. Simultaneously the male die member 20 is fixed to the associated component of the embossing tool, for example by means of suitable adhesive elements such as adhesive strips. The two components of the embossing tool can then be moved away from each other again. When that happens the spring member 52 of the respective positioning device 14 is mechanically relieved of stress again, that is to say the holding element 18 moves from the retracted position of releasing the male die member 20 into the active position of extending out of the housing element 16. The positioning device 14 can then be removed from the hole 12 in the female die member 10 by means of a suitable gripping tool as referred to above so that thereafter there is no positioning device 14 that could impede access to the embossing space between the female die member 10 and the male die member 20.

It will be noted in the above-described operating procedure that the spring ring 58 of rubber material serves to become clamped in the hole in the male die member 20 or to urge the male die member 20 against the annular flange 26 on the housing element 16, if the holding pin portion 54 is of a suitable longitudinal dimension. At any event the holding pin portion 54 projects beyond the male die member 20 when temporarily retained to the positioning device 14. When the assembly of the male and female die members is then clamped between the two movable components of the embossing tool, the holding pin portion 54 is moved back into the housing element 16 and the male die member 20 is suitably fixed to the associated component of the embossing tool. The movement of the holding pin portion 54 back into the housing element 16 means that the male die member is at the same time automatically released from the positioning device 14 and thus the female die member 10. After the male and female die members have then been moved away from each other, it is readily possible for the positioning device 14 to be removed from the die member on which it is mounted.

It will be seen therefore that the invention provides a positioning device which can be readily fitted to and removed from its operative position in relation to the embossing tool on which it is to be used, with the provision of a holding element which is displaceable between a position of holding a workpiece to be stamped fast and a retracted position of releasing the workpiece, in relation to the housing element of the positioning device.

It will be noted that the above-described embodiment of the invention has been set forth solely by way of example and illustration of the principles of the invention and that various modifications and alterations may be made therein without thereby departing from the spirit and scope of the invention.

What is claimed is:

1. A positioning device for accurately positioning a male die member of an embossing tool and a female die member of the embossing tool in relation to each other, comprising: a housing means adapted to be fixed to one of the die members; a holding means in the housing means adapted to be axially displaceable with respect to the housing means between a first position in which it engages the other of the die members thereby to hold said other die member fast and a second position in which it is retracted into the housing means thereby to release said other die member; and a spring means operatively disposed between the housing means and the holding means and adapted to be mechanically stressed in said second retracted position of the holding means.

2. A positioning device for accurately positioning a male die member of an embossing tool in relation to a female die member of the embossing tool, comprising: a housing element adapted to be fixed in a hole in the female die member; a holding element disposed in the housing element and adapted to be axially displaceable with respect to the housing element between a first position in which it projects into a hole in the male die member and holds the male die member fast and a second position in which it is retracted into the housing element and releases the male die member; and a spring member operatively disposed between the housing element and the holding element and adapted to be mechanically stressed in said second retracted position of the holding element.

3. A positioning device as set forth in claim 2 wherein said housing element is of a sleeve-like configuration having an outside peripheral surface in which there is provided a groove which extends around the housing element, and further including a spring ring accommodated in said groove.

4. A positioning device as set forth in claim 3 wherein the groove and the spring ring are so dimensioned that the spring ring has an outside peripheral portion projecting beyond said outside peripheral surface of said housing element.

5. A positioning device as set forth in claim 3 wherein the spring ring comprises a spring metal and is in the form of an open O-ring.

6. A positioning device as set forth in claim 2 wherein the housing element has an end portion which is towards the male die member and the housing element is provided at said end portion with an annular flange.

7. A positioning device as set forth in claim 6 wherein the annular flange has a portion of an undercut configuration.

8. A positioning device as set forth in claim 2 wherein the holding element is of a piston-like configuration having a holding pin portion adapted to project out of the housing element, wherein the housing element has a terminal closure portion, and wherein the spring member bears against the terminal closure portion of the housing element.

9. A positioning device as set forth in claim 8 wherein the holding pin portion has a groove which extends around the periphery thereof, and further including a spring ring accommodated in said groove.

10. A positioning device as set forth in claim 9 wherein the groove and the spring ring are so dimensioned that the spring ring has an outside peripheral portion projecting radially beyond said holding pin portion.

11. A positioning device as set forth in claim 9 wherein the spring ring comprises a rubber material and is in the form of a closed O-ring.

12. An embossing tool including a male die member; a female die member; means for producing relative movement of the male and female die members; and a positioning device for positioning the die members relative to each other, the positioning device comprising: a housing element adapted to be fixed to one of the die members; a holding element disposed in the housing element and adapted to be axially displaceable with respect to the housing element between a first position in which it engages the other of the die members to hold said other die member fast and a second position in which it is retracted into the housing element to release said other die member; and a spring means operatively disposed between the housing element and the holding element and adapted to be mechanically stressed in said second retracted position of the holding element.

* * * * *

UNITED STATES PATENT AND TRADEMARK OFFICE

CERTIFICATE OF CORRECTION

PATENT NO. : 5,694,838

DATED : Dec. 9, 1997

INVENTOR(S) : Herbert Moll

It is certified that error appears in the above-identified patent and that said Letters Patent is hereby corrected as shown below:

On the title page, item [73],
Assignee's name and address should read:

Hinderer & Mühlich KG

Göppingen
Germany

Signed and Sealed this

Twenty-eighth Day of April, 1998

Bruce Lehman

*Attest:*

BRUCE LEHMAN

*Attesting Officer*

*Commissioner of Patents and Trademarks*